United States Patent [19]

Giulie

[11] 4,396,119

[45] Aug. 2, 1983

[54] STORAGE BOX

[76] Inventor: Joe D. Giulie, P.O. Box 10101, Palo Alto, Calif. 94303

[21] Appl. No.: 297,235

[22] Filed: Aug. 28, 1981

[51] Int. Cl.[3] ..... B65D 85/57

[52] U.S. Cl. ..... 206/425; 206/45.23; 220/332; 220/DIG. 25

[58] Field of Search ..... 206/425, 45.23, 45.2; 220/DIG. 25, 332

[56] References Cited

U.S. PATENT DOCUMENTS 3,783,999 1/1974 Smith ..... 206/45.23

FOREIGN PATENT DOCUMENTS 1905723 9/1969 Fed. Rep. of Germany ... 220/DIG. 25

*Primary Examiner*—William T. Dixson, Jr.
*Attorney, Agent, or Firm*—Robert G. Slick

[57] ABSTRACT

A storage container is provided of simple, two piece construction which is in the form of two U-shaped members, one of which can be inverted over the other to form a closed container and which has guide means whereby the top member can be tilted back to open the container.

3 Claims, 5 Drawing Figures

STORAGE BOX

SUMMARY OF THE INVENTION

The present invention relates to a container which was particularly designed to hold regular or miniature floppy discs although it will be understood, of course, that the container could be used for any purpose.

The container of the present invention is of very simple construction and is preferably made of a plastic material which can be readily formed.

The container of the present invention is highly advantageous in that it can be made of a clear plastic allowing the contents to be readily seen.

Conventional boxes occupy a large amount of space when the cover is open. The cover of the present invention tucks neatly behind the box so that the container occupies little more counter space when open than when closed.

Various other features and objects of the invention will be brought out in the balance of the specification.

DESCRIPTION OF THE PREFERRED EMBODIMENT

Figure 1:
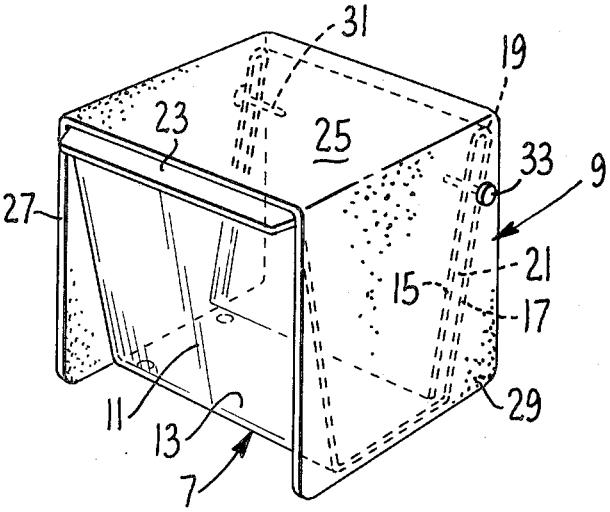
FIG. 1 is a perspective view of a container embodying the present invention, showing the container in the closed position.

Referring now to the drawings by reference characters the container of the present invention consists of two U-shaped members generally designated 7 and 9.

Member 7 is in the form of a flat bottomed U and consists of sheet plastic wherein the plastic has been formed to form a front wall 11, a bottom 13 and a back wall. The back wall is comprised of a double thickness of plastic including an inner back wall 15 and an outer back wall 17 formed over the fold line 19. By having the double back wall, slot 21 is thus formed between the walls, the purpose of which will later be explained. Preferably, front wall 11 has an outstanding lip 23 so that the container may be easily grasped. Since the container was designed primarily to hold floppy discs, it is desirable that the discs within the container be held at an angle so that it is easy to finger through the discs to select a desired one. Accordingly, it is preferable that the front and back walls 11 and 15 slope outwardly from the bottom so that the bottom 13 is smaller in area than the opening formed between the tops of parts 11 and 15. Thus any articles placed within the container of a flat nature such as records, would be held at a convenient angle.

Figure 2:
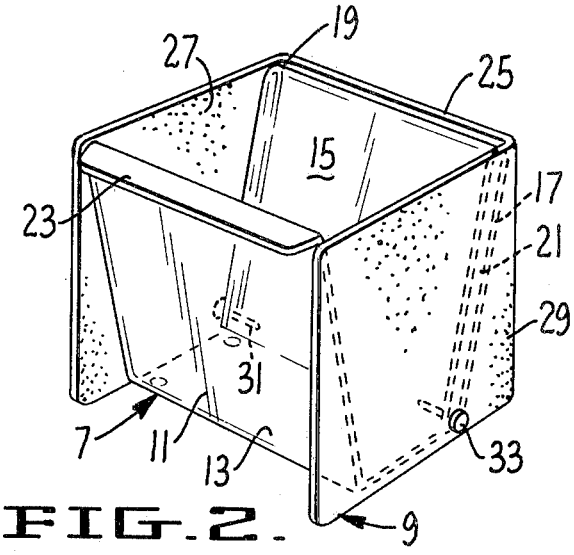
FIG. 2 is a perspective view showing the container in the open position.
Figure 3:
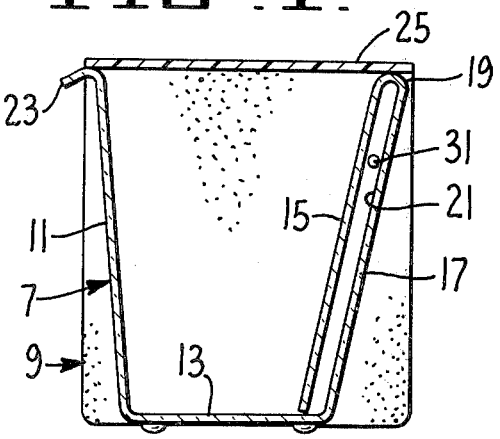
FIG. 3 is a section taken near one edge of the container.
Figure 4:
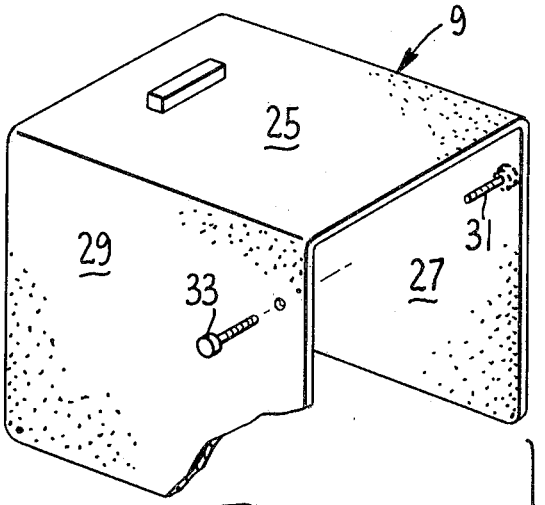
FIG. 4 is a perspective view of that portion of the container showing the front wall, top and back wall.
Figure 4:
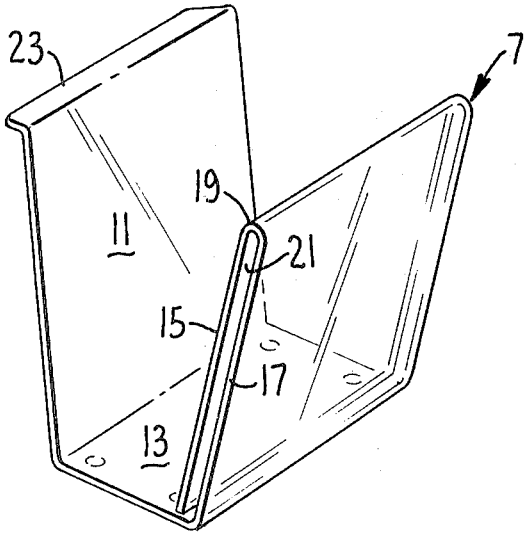

The top member 9 also consists of a flat inverted U formed of a single piece of plastic which defines the top 25 and the sides 27 and 29. Near the top of the side walls and to the rear thereof are the two inwardly extending pins 31 and 33. The pins 31 and 33 fit within the slot 21 formed between the inner 15 and outer 17 back walls. The operation of the box is readily apparent with reference to FIGS. 1 and 2. In FIG. 1 the box is shown in a closed position with the pins 31 and 33 near the top of slot 21. Now, if one wishes to open the box it is merely necessary to raise up on the front portion of the top 25 and slide it backwards whereupon the pins 31 and 33 will move downwardly into the slot as is shown in FIG. 2, leaving the box open at the top. It will be noted that the sides 27 and 29 still form the sides of the container but now their position has been shifted through 90°. It will also be noted that the desk space occupied by the box is little, if any, increased when the box is open.

Figure 5:
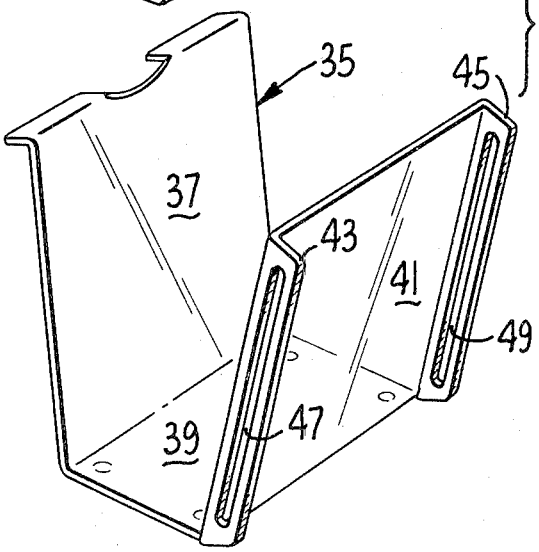
FIG. 5 is an exploded view of another embodiment of the invention.

In FIG. 5 another embodiment of the invention is shown which utilizes the same top portion as has been previously described, but which uses a bottom which is more economical of plastic. Here the bottom member, designated 35, has a front wall 37, a bottom 39 and a single back wall 41 which has lips 43 and 45 extending at a right angle to the back wall. Slots 47 and 49 are formed in these lips as shown. The operation of the device is as previously described wherein the pins 31 and 33 engage in slots 47 and 49 instead of the slot 21

Preferably, the box of the present invention is made of two U-shaped ejection molded plastic members although other construction techniques and materials may be utilized. In one attractive embodiment of the box, the bottom member 7 was made of a clear plastic while the top member 9 was made of an opaque plastic.

Many variations can be made in the exact structure shown without departing from the spirit of this invention. For instance, instead of utilizing the pins 31 and 33, one could have a rod extending completely across the back of the box. Also, in that embodiment shown in FIG. 5 it is not necessary that the lips extend to the rear but they could extend toward the front edge of the box.

What is claimed is:

1. A storage container wherein the front and back walls slope inwardly from the top whereby the bottom of the container is smaller than the top opening comprising in combination:

a. a first U-shaped member, said member comprising the front, back and bottom walls of the container, b. a second member in the form of an inverted U comprising the two sides and the top wall of the container adapted to fit over the top of the first U-shaped member to form a closed container, c. straight slot means extending from substantially the top of the bottom of each edge along the slope of said back wall of said container, d. pin means extending inwardly from near the top edges of the two sides of the second member to engage said slot means, whereby, e. said second member is slideable along said slot means to a first position wherein said container is completely closed and to a second position wherein said container is open with the top wall lying against and behind the back member.

2. The container of claim 1 wherein said slot means is formed on lips on the back wall.

3. The container of claim 1 wherein the back wall is double to form said slot means between said double walls.

* * * * *